US005165743A

United States Patent [19]

Zock

[11] Patent Number: 5,165,743

[45] Date of Patent: Nov. 24, 1992

[54] TAILGATE LOCKING DEVICE, SYSTEM AND METHOD

[76] Inventor: Ronald F. Zock, R.D. #1, Box 135, Youngsville, Pa. 16371

[21] Appl. No.: 802,059

[22] Filed: Dec. 3, 1991

[51] Int. Cl.[5] ..... E05C 19/18

[52] U.S. Cl. ..... 292/288; 292/DIG. 3; 292/DIG. 5; 292/DIG. 43

[58] Field of Search ..... 70/14, 211; 292/307, 292/318, 258, 288, DIG. 43, DIG. 3, DIG. 5; 29/437

[56] References Cited

U.S. PATENT DOCUMENTS

| | | | |
|---|---|---|---|
| 2,443,850 | 6/1948 | Clapp | 70/211 |
| 2,463,195 | 3/1949 | Mungan | 70/416 |
| 2,515,364 | 7/1950 | Weaver | 292/288 X |
| 2,537,380 | 1/1951 | Trovis | 292/288 |
| 2,618,497 | 11/1952 | Gardels | 292/265 |
| 2,973,217 | 2/1961 | Gregoire | 292/288 |
| 3,555,752 | 1/1971 | Bogaert | 292/258 X |
| 4,004,833 | 1/1977 | Hull | 292/288 |
| 4,068,504 | 1/1978 | Pickard | 70/14 |
| 4,389,862 | 6/1983 | Hastings | 292/288 X |
| 4,460,203 | 7/1984 | Moberg et al. | 292/318 |
| 4,819,461 | 4/1989 | Pearson | 70/14 |

*Primary Examiner*—Richard E. Moore
*Attorney, Agent, or Firm*—Lovercheck and Lovercheck

[57] ABSTRACT

A device, system and method of tailgate locking in accordance with the invention includes a lock housing, a locking member and a bracket having a flange. The bracket is connected to the lock housing. The locking member is releasably connected to the lock housing and adapted to engage a truck canopy handle. The bracket is adapted to engage a truck tailgate handle. In accordance with the method of the invention a pick-up truck canopy handle is effectively locked to a truck tailgate handle using the locking device.

20 Claims, 1 Drawing Sheet

TAILGATE LOCKING DEVICE, SYSTEM AND METHOD

BACKGROUND OF THE INVENTION

The invention relates to a lock. The invention provides an improved tailgate lock.

Pearson in U.S. Pat. No. 4,819,461 disclose a truck canopy and tailgate locking means.

Mungan in U.S. Pat. No. 2,463,195 and Hull in U.S. Pat. No. 4,004,833 discloses locking devices.

Travis in U.S. Pat. No. 2,537,380 discloses an automobile door handle safety device.

Gardels in U.S. Pat. No. 2,618,497 discloses a lockable trunk lid extension for automobiles.

Gregoire in U.S. Pat. No. 2,973,217 discloses a lockable trunk lid holder for automobiles.

The improvements of the invention each taken alone or in combination add to resolve the problems of the prior art.

SUMMARY OF THE INVENTION

A device, system and method of tailgate locking is provided in accordance with the invention. The locking device has a lock housing, a locking member and a bracket having a flange. The bracket is connected to the lock housing. The locking member is releasably connected to the lock housing and adapted to engage a truck canopy handle. The bracket is adapted to engage a truck tailgate handle. In accordance with the method of the invention a pick-up truck canopy handle is effectively locked to a truck tailgate handle using the locking device.

It is an object of the invention to provide a tailgate locking device having a lock, and a bracket having a flange adapted to engage a tailgate handle.

It is an object of the invention to provide a tailgate locking device having a lock housing. a locking member and a bracket having a flange connected to the housing.

It is an object of the invention to provide a tailgate locking device having a lock housing, a bracket having a flange connected to the housing and a locking member releasably connected to the housing and adapted to engage a truck canopy handle.

It is an object of the invention to provide a tailgate locking device having a lock housing, a bracket having a flange connected to the housing and adapted to engage a truck tailgate handle and locking member releasably connected to the housing and adapted to engage a truck canopy handle.

It is an object of the invention to provide a method of locking a pick-up truck tailgate to a truck canopy by a locking device having a lock, a bracket having a flange adapted to engage the tailgate handle, and a locking member bracket adapted to engage the canopy handle whereby the canopy is effectively locked to the tailgate.

One problem of the tailgate lock of the prior art is the need for connection to a bumper. Another problem of the tailgate lock of the prior art is that it is not adapted to be connected to a tailgate handle. These problems of the prior art are overcome by the improved tailgate lock of the present invention. The improvements of the present invention beneficially provide a novel, nonobvious and useful manner of tailgate locking.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
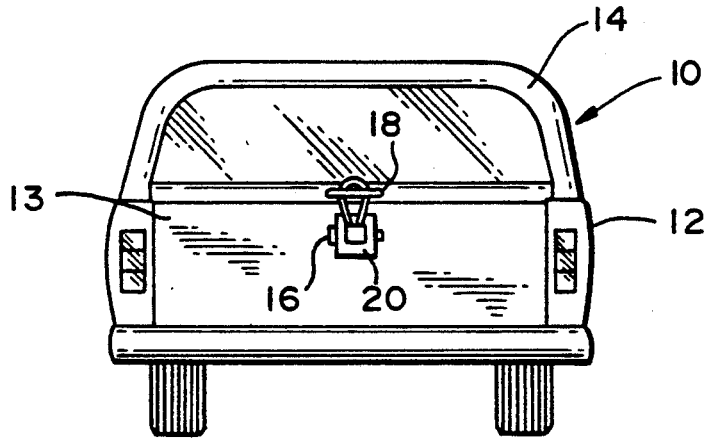
FIG. 1 is a rear view of a truck having a tailgate lock in accordance with the invention.
Figure 2:
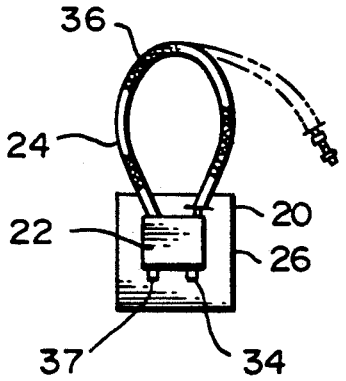
FIG. 2 is a front view of a tailgate lock in accordance with the invention.

The preferred embodiment of the invention is illustrated by way of example in FIGS. 1–7. Referring to the FIGURES, in which like numerals refer to like portions thereof FIG. 1 shows tailgate locking system 10 in accordance with the present invention. Tailgate locking system 10 includes pick-up truck 12 having tailgate 13 and truck canopy 14. Tailgate 13 has tailgate handle 16. Truck canopy 14 has canopy handle 18. Tailgate locking device 20 includes a lock having metal housing 22, locking member 24 and bracket 26. Bracket 26 is connected to housing 22 and has U-shaped portion 27. Bracket 26 includes lower metal flange 28 and upper metal flange 30. Locking member 24 includes notched legs 32 and 34 connected by cable 36. In use, flanges 28 and 30 of bracket 26 engage handle 16 and cable 36 is positioned between handle 18 and canopy 14, while notched legs 32 and 34 extend into lock 22 in locked position. By unlocking lock 22 one or both of notched legs 32 and 34 are readily removed from lock 22 so that cable 36 may be removed from between handle 18 and canopy 14.

Figure 3:
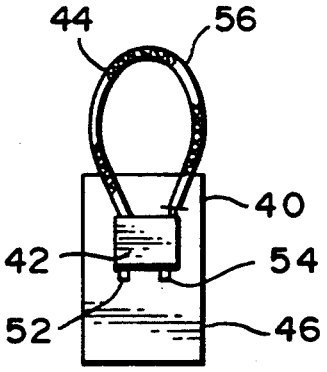
FIG. 3 is a front view of a tailgate lock in accordance with the invention.
Figure 6:
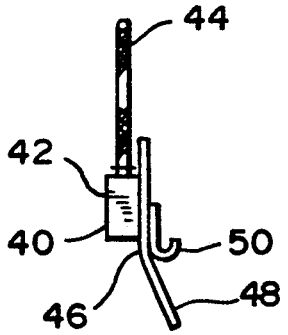
FIG. 6 is a side view of the tailgate lock in accordance with the invention shown in FIG. 3.

With more particular reference to FIGS. 3 and 6 it is seen that tailgate locking device 40 includes a lock having metal housing 42, locking member 44 and bracket 46. Bracket 46 is connected to housing 42 and includes lower flange 48 and upper flange 50. Locking member 44 includes notched legs 52 and 54 connected by cable 56.

Figure 4:
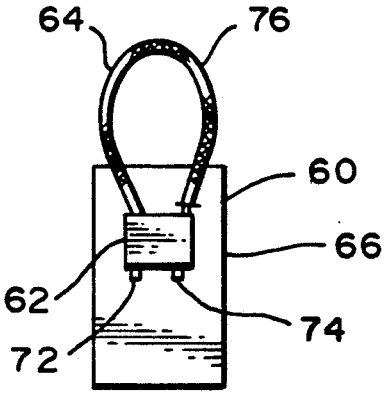
FIG. 4 is a front view of a tailgate lock in accordance with the invention.
Figure 5:
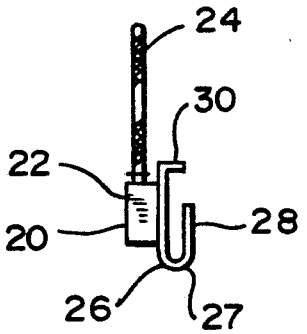
FIG. 5 is a side view of the tailgate lock in accordance with the invention shown in FIG. 2.
Figure 7:
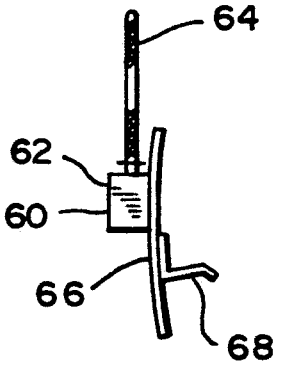
FIG. 7 is a side view of the tailgate lock in accordance with the invention shown in FIG. 4.

With more particular reference to FIGS. 4 and 7 it is seen that tailgate locking device 60 includes a lock having metal housing 62, locking member 64 and bracket 66. Bracket 66 is connected to housing 62 and includes flange 68. Locking member 64 includes notched legs 72 and 74 connected by cable 76.

OPERATION

In use, to lock canopy handle 18 of truck canopy 14 to tailgate handle 16, bracket flanges 28 and 30 are inserted above and below tailgate handle 16. Lock 22 is unlocked and at least one of the notched legs 32 and 34 is removed therefrom and cable 36 is extended between handle 18 and canopy 14. The leg(s) removed from lock 22 are reinserted effectively locking canopy 14 to tailgate 13. By unlocking lock 22 one or both of notched legs 32 and 34 are readily removed from lock 22 so that canopy 14 is unlocked from tailgate 13.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A tailgate locking device, comprising:

a lock housing, a locking member and a bracket having a flange, said bracket being connected to said housing, said locking member being releasably connected to said housing and adapted to engage a truck canopy handle, said bracket being adapted to engage a truck tailgate handle.

2. The tailgate locking device recited in claim 1 wherein said bracket has an upper and a lower flange.

3. The tailgate locking device recited in claim 2 wherein said bracket has said upper flange spaced from said lower flange.

4. The tailgate locking device recited in claim 1 wherein said locking member comprises at least one notched leg.

5. The tailgate locking device recited in claim 1 wherein said locking member comprises a first and a second notched leg.

6. A tailgate locking system, comprising:

a locking device having a lock housing, a locking member and a bracket having a flange;

said bracket being connected to said housing;

said locking member being releasably connected to said housing;

a truck canopy having a canopy handle and a truck tailgate having a tailgate handle;

said locking member being adapted to engage said canopy handle; and, said bracket being adapted to engage said tailgate handle whereby said canopy is effectively locked to said tailgate.

7. The tailgate locking system recited in claim 6 wherein said bracket has an upper and a lower flange.

8. The tailgate locking system recited in claim 6 wherein said flange has a generally U-shaped portion.

9. The tailgate locking system recited in claim 6 wherein said locking member comprises at least one notched leg.

10. The tailgate locking system recited in claim 6 wherein said locking member comprises a first and a second notched leg.

11. The tailgate locking system recited in claim 6 wherein said locking member comprises a cable or rod.

12. The tailgate locking system recited in claim 6 wherein said flange comprises a U-shaped portion.

13. A method of locking a pick-up truck tailgate to a truck canopy, comprising:

providing a locking device having a lock, a locking member, and a bracket having a flange;

engaging said bracket and a tailgate handle;

engaging said locking member and a canopy handle whereby said canopy is effectively locked to said tailgate.

14. The method of claim 13 wherein said bracket has an upper and a lower flange.

15. The method of claim 13 wherein said flange is integrally attached to said bracket and extends laterally therefrom.

16. The method of claim 13 wherein said locking member comprises at least one notched leg.

17. The method of claim 13 wherein said locking member comprises a first and a second notched leg.

18. The method of claim 13 wherein said locking member comprises a cable or rod.

19. The method of claim 13 wherein said flange comprises a U-shaped portion.

20. The method of claim 13 wherein said flange and locking member each comprise metal.

* * * * *